United States Patent [19]

Hrboka

[11] Patent Number: 4,805,344

[45] Date of Patent: Feb. 21, 1989

[54] AUTOMATIC DOOR LOCKING ASSEMBLY

[76] Inventor: Deso I. Hrboka, P.O. Box 2242, Oxnard, Calif. 93034

[21] Appl. No.: 138,568

[22] Filed: Dec. 28, 1987

[51] Int. Cl.[4] ..... E05F 15/00

[52] U.S. Cl. ..... 49/280; 49/199; 160/188

[58] Field of Search ..... 49/280, 360, 199, 200; 160/189, 188

[56] References Cited

U.S. PATENT DOCUMENTS

| | | | |
|---|---|---|---|
| 2,589,479 | 3/1952 | Curtis | 160/188 X |
| 2,822,166 | 2/1958 | Herbert | 49/199 |
| 3,435,558 | 4/1969 | Kruse | 49/200 |
| 3,526,994 | 9/1970 | Delaney | 49/199 |
| 3,704,548 | 12/1972 | Wiegleb | 49/199 |
| 3,708,917 | 1/1973 | Streeter | 49/280 |
| 4,330,958 | 5/1982 | Richmond | 49/280 |
| 4,442,631 | 4/1984 | Weber | 49/199 |
| 4,513,593 | 4/1985 | Wilson | 70/114 |
| 4,597,224 | 7/1986 | Tucker | 49/199 |

*Primary Examiner*—Philip C. Kannan

*Attorney, Agent, or Firm*—Kenneth J. Hovet

[57] ABSTRACT

A deadbolt assembly adapted for use with automatic door openers having a movable carriage power driven on a track mounted above the door. A lift arm connects the carriage to the door which swings the door up and down about a horizontal axis in response to movement of the carriage. A deadbolt shaft reciprocates within a sleeve which is secured to the lower inside portion of the door. The shaft locks the door when closed by engagement with a lock opening. A cable connects the shaft to the carriage so that the shaft is lifted out of the opening as the carriage moves to lift the door. A slotted bracket connection between the door and lift arm provides a lost motion action to delay door movement until the shaft is out of the opening. In an alternative embodiment, the lift arm includes a free end at the bracket connection. The door connection includes slots which allow the free end to extend beyond the bracket and engage a door header opening after the door is closed. This locks the door in a closed position without the necessity of the deadbolt shaft and cable.

18 Claims, 4 Drawing Sheets

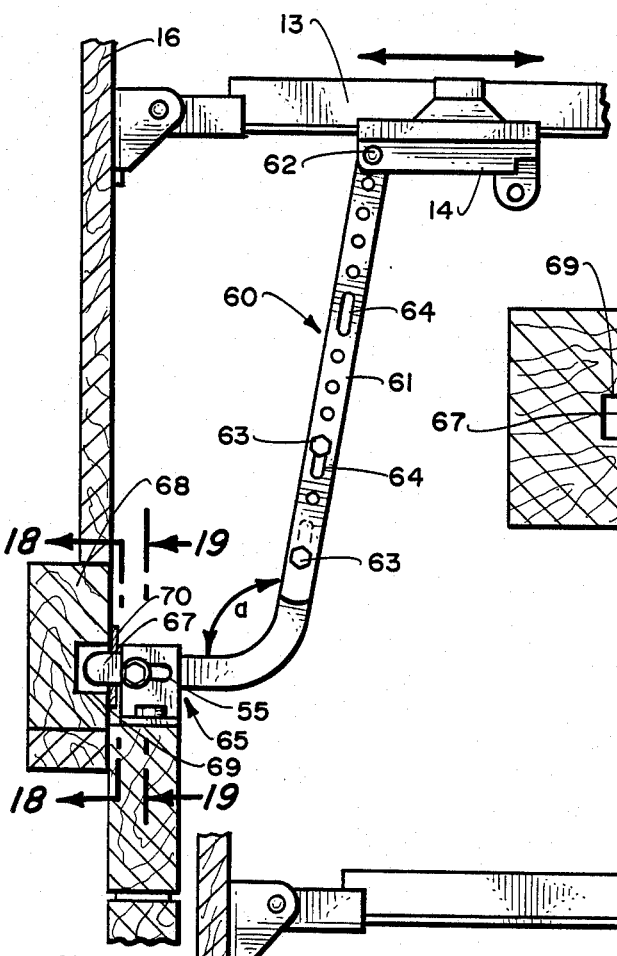
Fig. 14.
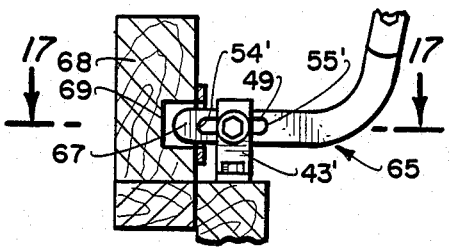
Fig. 16.
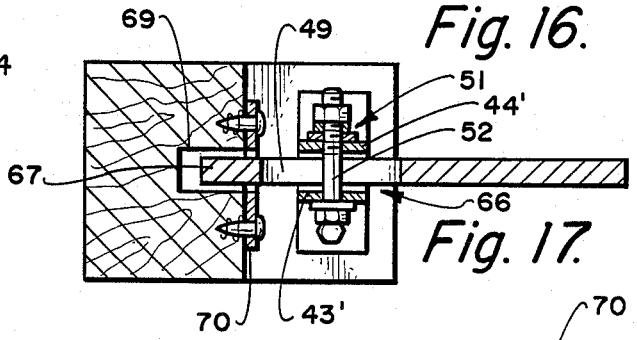
Fig. 17.
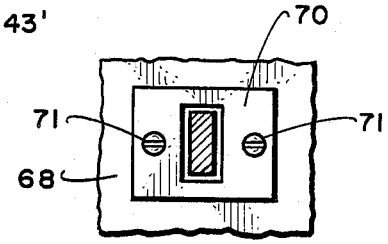
Fig. 18.
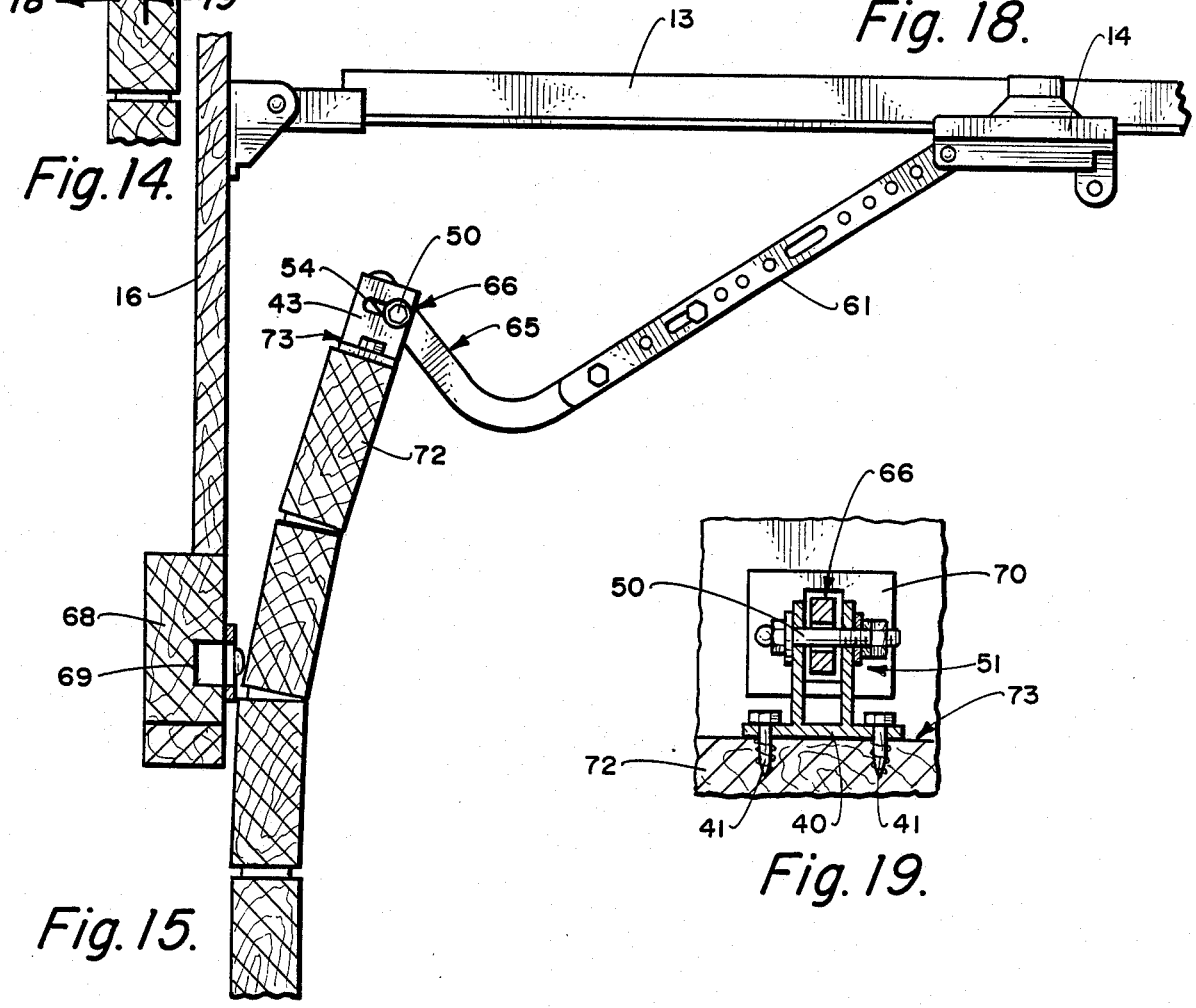
Fig. 15.
Fig. 19.

AUTOMATIC DOOR LOCKING ASSEMBLY

BACKGROUND OF THE INVENTION

1. Field of the Invention

The present invention relates to automatic door opening systems. More particularly, it pertains to an overhead door locking assembly that operates as part of a door opening system.

2. Description of the Prior Art

For large overhead doors that roll-up or swing-out, the use of automatic openers have become common. Such openers typically utilize a track mounted above the door for supporting a power-driven carriage. An elongated link arm connects the door to the carriage whereby the door will move in response to carriage movement.

Problems have been encountered in preventing unauthorized intrusion due to the inherent slack in the overall system. There is usually sufficient looseness in the various joints, the track/carriage/drive connections and the door construction itself, to permit wedging of the door bottom and unauthorized entry. Numerous mechanisms have been devised to overcome this problem.

In U.S. Pat. Nos. 3,435,558 and 3,526,994, a cam-operated latching mechanism is provided between the carriage and track means. This serves to prevent unwanted carriage movement, but does not address loose arm connections and inherent door flexure.

U.S. Pat. No. 2,589,479 avoids the above deficiencies with a sliding bolt lock. The bolt traverses the top edge of the door and engages a door frame keeper to stop unwanted raising of the door. While this is effective for roll-up panel doors, it requires a bell crank arm and associated parts making it cumbersome and costly. Further, it is actuated by a keyed outside handle which, can be accessed by an experienced intruder.

Door locks that automatically operate in conjunction with carriage movement are shown in U.S. Pat. Nos. 3,708,917; 4,442,631 and 4,597,224. Each of the above devices are distinguishable by the type of delay or lost-motion mechanism that is used to disengage the locks prior to door movement. In U.S. Pat. No. 4,597,224, the door arm comprises two sliding parts surrounded by the coils of a spring retained between opposing collars. Relative movement between the parts allows the carriage to unlock rocker latches prior to door movement.

In the aforementioned U.S. Pat. Nos. 3,708,917 and 4,442,631, a bell crank lever and rocker plate, respectively, are the mechanical means by which unlocking occurs before door movement. In each of the above cases, substantial changes to conventional systems are required. As such, retrofitting of existing door operating devices is not economically viable. Also, the patented mechanisms require carefully aligned pivot parts which further require properly tensioned spring means. Such assemblies inherently create upkeep and maintenance problems. Still further, they are costly to purchase and are not amenable for the average householder to install.

SUMMARY OF THE INVENTION

The invention overcomes the complications of prior art mechanisms by providing a door locking assembly that operates by gravity and by means already present for opening the door. A deadbolt shaft is drawn by gravity into a lock opening when the door is vertical.

Before the door is raised by a lift arm and carriage means, a delay bracket allows the carriage to move the deadbolt shaft out of the opening. Thereafter, the carriage, door and shaft move together to an open position.

Particularly for roll-up multi-panel doors, a modified lift arm is used in conjunction with the delay bracket. When the door is lowered to a vertical position, a locking portion of the lift arm is moved by the carriage into a header lock opening. When the carriage moves to raise the door, the delay bracket allows the locking portion to disengage from the opening before the door is moved.

BRIEF DESCRIPTION OF THE DRAWINGS

FIG. 14 is a cross-sectional view showing an alternative version of the invention with a modified lift arm and retention means in use with a multi-panel door in closed position.

FIG. 15 is the assembly of FIG. 14 showing the door partially elevated.

FIG. 16 is a cross-sectional view similar to FIG. 14 showing an alternative bracket means and slotted lift arm.

FIG. 17 is an enlarged cross-sectional view taken along lines 17—17 of FIG. 16.

FIG. 18 is a cross-sectional view taken along lines 18—18 of FIG. 14.

FIG. 19 is a cross-sectional view taken along lines 19—19 of FIG. 14.

DESCRIPTION OF THE PREFERRED EMBODIMENTS

With reference now to the drawings, the invention will be discussed in relation to its incorporation with conventional automatic door opening systems. As used herein the systems function to raise heavy doors along opposing side tracks (as with multi-panel roll-up doors) or about side hinge mechanisms defining a horizontal axis (as with single panel hinged doors). In both cases, the door opening systems utilize a powered drive means 12 to operate a track (or transmission) means 13.

A carriage 14 is mounted upon the track means and moves thereon in response to actuation of said drive means. A lift arm 15 connects the door to the carriage whereby reciprocation of the carriage will raise and lower the door. The lift arm is generally an elongated flat bar member which is curved at one end. It usually hangs edgewise below the track means.

Figure 1:
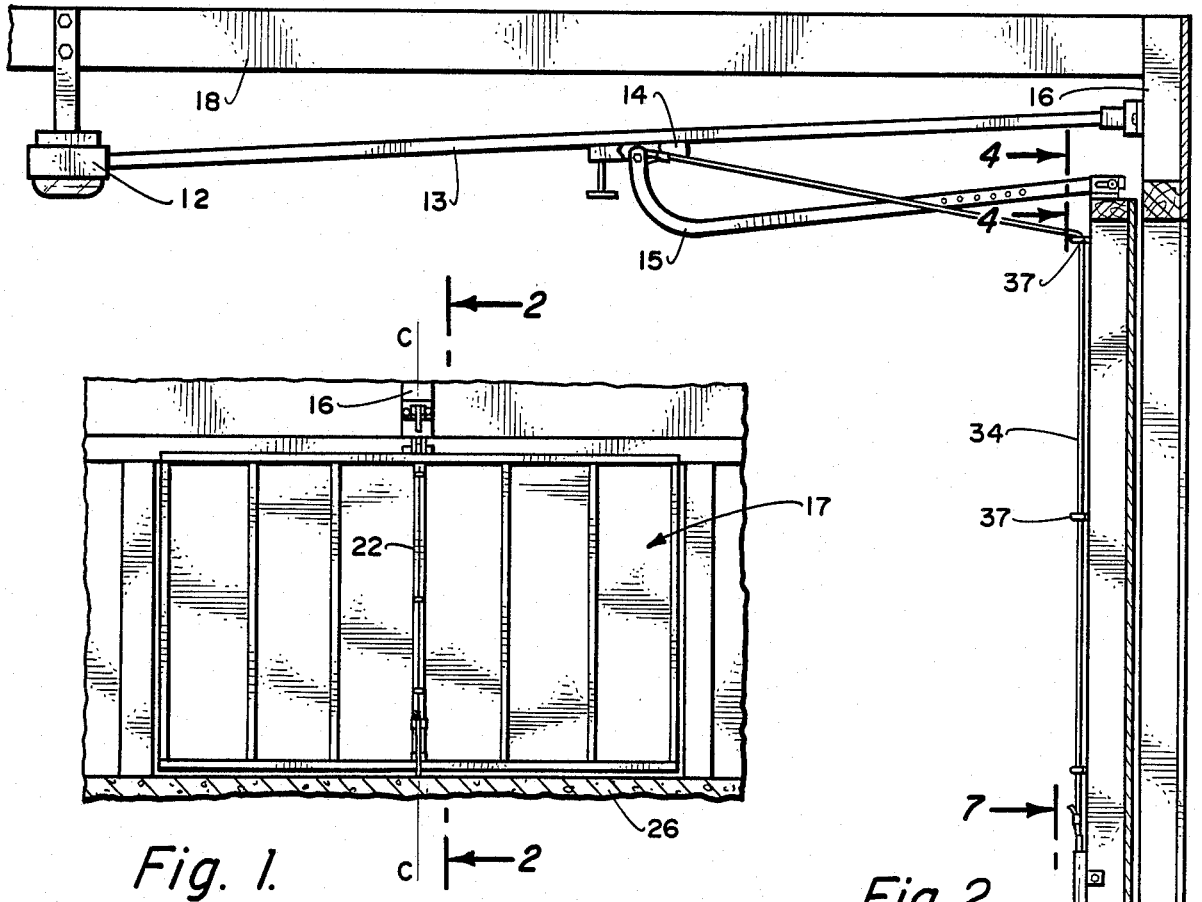
FIG. 1 is an elevational view showing the inside of a single panel door in closed position with an automatic door opener system and the locking assembly of the invention.
Figure 2:
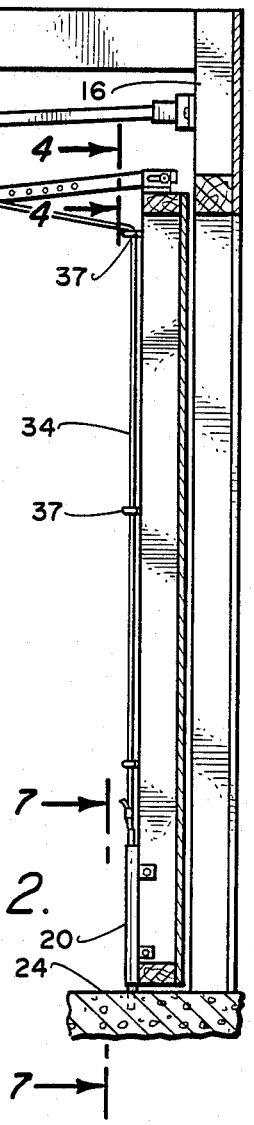
FIG. 2 is an enlarged cross-sectional view taken along lines 2—2 of FIG. 1.

As best shown in FIGS. 1 and 2, the track means is a linear chain or screw mechanism. It is mounted at its front end to supporting structure 16 above the center line c,c of single panel door 17. It extends rearward about perpendicular to the horizontal axis of the door when in a closed position as shown. The back end engages drive means 12 which is secured to beam 18 of the supporting structure.

In FIGS. 1–13, the invention comprehends the use of a deadbolt lock assembly to secure the closed door 17 from jimmying or other unauthorized intrusion. Such assembly includes a guide means shown as vertical sleeve 20. The sleeve has mounting flanges 21 for securement by sleeve fasteners 27 to the lower inside portion of door frame member 22. The lower sleeve end 23 is proximate the bottom end 24 of the door.

Figure 7:
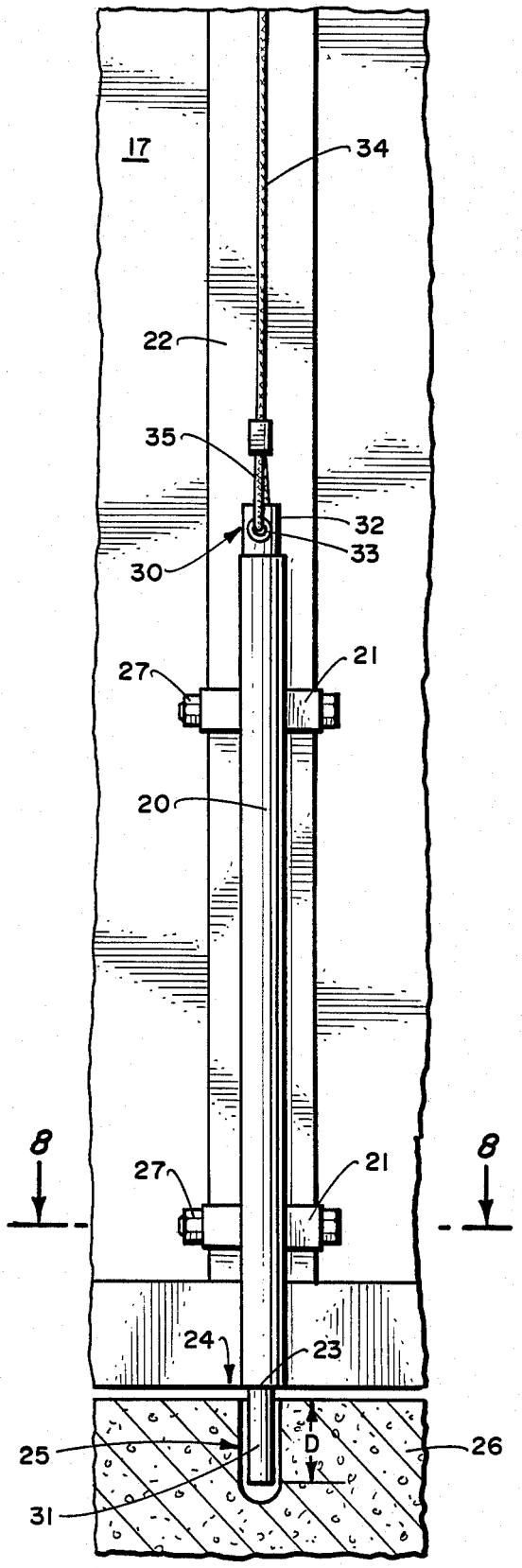
FIG. 7 is an enlarged fragmentary elevational view taken along lines 7—7 of FIG. 2.
Figure 8:
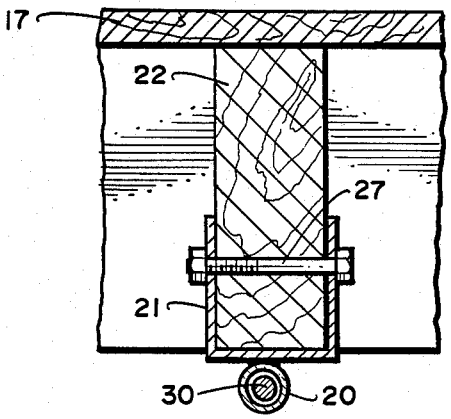
FIG. 8 is a cross sectional view taken along lines 8—8 of FIG. 7.

Directly below the sleeve end is a keeper means. This may comprise a lock opening 25 in floor 26 as shown in FIG. 7. Alternatively, it may be a conventional pipe collar secured to the floor surface (not shown).

Mounted for reciprocation within the sleeve is shaft 30. The shaft is a straight structural element having a length greater than the sleeve. It is desirable that the shaft and sleeve have similar cross-sectional shapes to facilitate shaft movement. The shaft includes a locking tip end 31 that engages the keeper means when door 17 is in the closed position. The tip end, at least, should be resistant to shear forces and be sufficiently heavy to overcome any counteracting friction forces upon its downward gravity movement within the sleeve.

Actuation means, shown as cable 34, is connected to the shaft lift end 32. The connection comprises a cable loop 35 through shaft aperture 33. Other actuation means, such as rope, wire, chain, belt or combinations thereof may be used. Preferably, such means should be flexible, but linearly unyielding.

From its connection with the shaft, the cable is threaded through eyelet means 37 on frame member 22 to carriage 14. The carriage connection most simply can comprise another cable loop 38 through or about any one of; a carriage aperture, clevis part or carriage crossbolt. It is important that the cable and cable connections be tight so that carriage movement will result in a substantially immediate like movement of the shaft.

As the carriage moves, so will the door via lift arm 15. However, upon the start of lifting, the invention contemplates use of an improved door movement delay means so that the gravity deadbolt assembly can first become disengaged. The delay means is part of a unique bracket means interconnecting the upper portion of door 17 to lift arm 15.

The bracket means for all embodiments of the invention includes a base plate 40 attached by plate fasteners 41 to the upper portion of an overhead door. As shown in FIGS. 1–13, the plate is attached to top end 42 of door 17. At least one, and preferably two, pivot plates 43,44 extend upwardly from the base plate. They are aligned with the door centerline and are parallel to the side of delay end 45 of the lift arm. The plates are spaced-apart a distance greater than the thickness of the delay end to form a slide channel 46. This arrangement allows for relative movement between the plates and the delay end.

The bracket delay means shown in FIGS. 1–10, 14, 15 and 19 comprises an elongated slot 48 through the pivot plate(s). It extends a predetermined distance across a major portion of the plate upper width and is generally horizontal when the door is down. A hinge pin 50 is secured to the delay end and extends transversly therefrom through the slots. Preferably, the pin is a hardened headbolt fastened with a conventional washer and nut combination 51. It hinges delay end 45 to the door and permits limited reciprocation defined by the slot length within slide channel 46.

Figure 5:
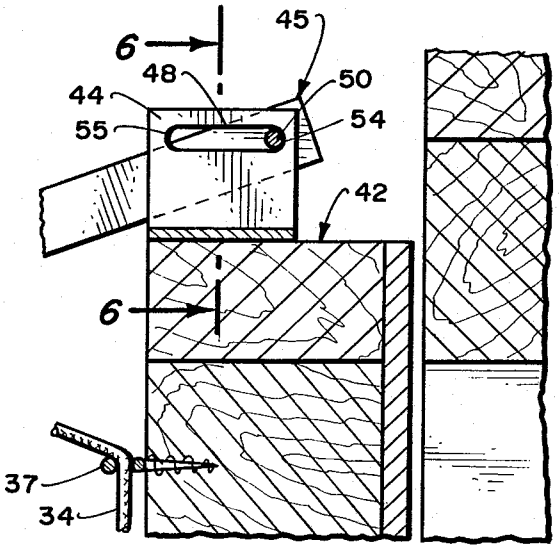
FIG. 5 is a cross-sectional view taken along lines 5—5 of FIG. 4.
Figure 4:
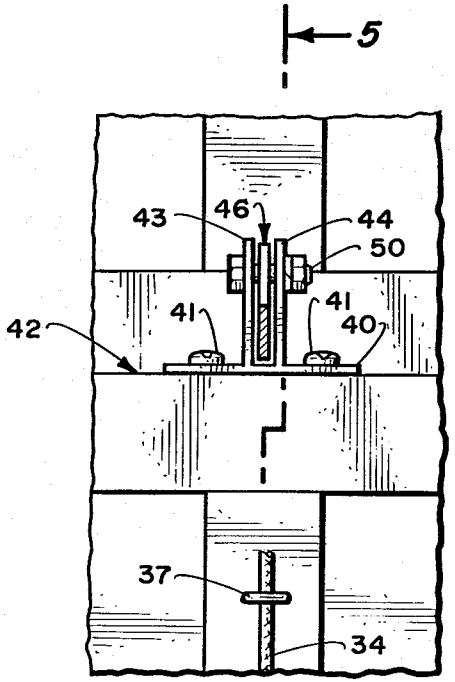
FIG. 4 is an enlarged fragmentary elevational view taken along lines 4—4 of FIG. 2.

As best shown in FIGS. 2 and 5, the hinge pin will abut forward end 54 of the slot to secure the door in a down position. Upon activation of drive means 12, the track means will draw the carriage rearward. This action will pull cable 34 through eyelet means 37 and cause shaft 30 to be lifted out of lock opening 25.

Figure 3:
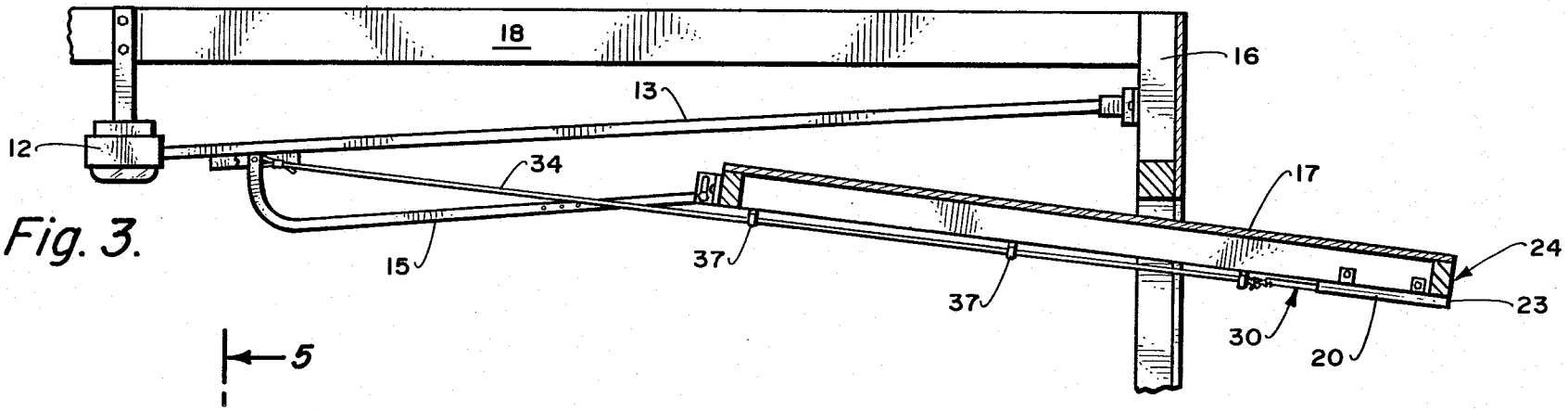
FIG. 3 is the door shown in FIG. 2 in an open position.
Figure 6:
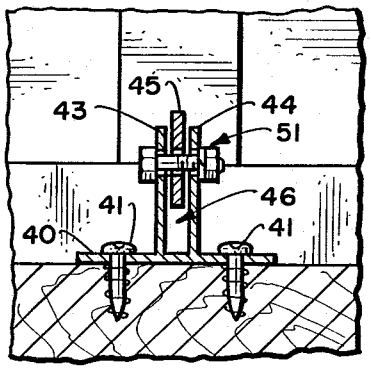
FIG. 6 is a cross-sectional view taken along lines 6—6 of FIG. 5.

Upon clearance of tip end 31 from the opening, hinge pin 50 will have slid across slot 48 into abutment with slot back end 55. At this point, carriage movement force will be transferred to the bracket means and the door will begin its upward swinging movement until it is fully open as seen in FIG. 3.

To insure that the tip end has cleared lock opening 25 prior to door movement, slot 48 must have a length greater than the tip engagement distance D. Further, the shaft guide means should retain control of the shaft at maximum shaft elevation when the door is fully open. In normal installations, this distance does not exceed one third the height of the door.

Figure 9:
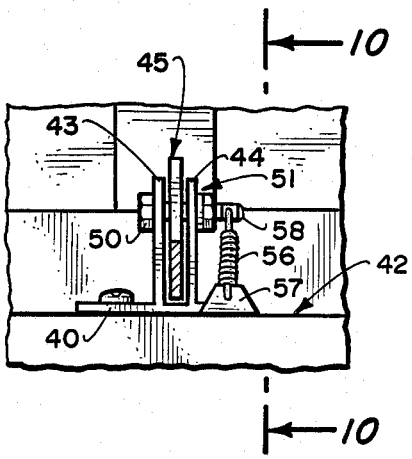
FIG. 9 is a fragmentary view similar to FIG. 4 showing the addition of a spring between the pivot pin and bracket flange.
Figure 10:
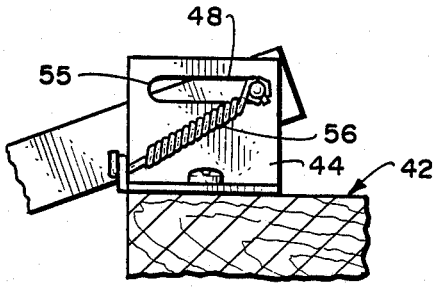
FIG. 10 is a side elevational view taken along lines 10—10 of FIG. 9.

To facilitate smooth operation of the door movement and locking mechanisms, the bracket means may include an optional spring biasing means. As shown in FIGS. 9 and 10, this comprises a tension spring 56 that connects base flange 57 with extension 58 of hinge pin 50. The spring biases pin 50 toward back end 55 of the elongated slot and provides smoother downward movement of the door.

With reference to FIGS. 11–13, 16 and 17, an alternative delay means is illustrated. The delay end 45 is provided with an elongated slot 49. The slot preferably extends along the median axis of the delay end. Hinge pin 52 extends through the slot and is secured to the unslotted opposing pivot plates 43',44'.

The delay movements are the same as before with the delay end reciprocating in slide channel 46. In this sequence, however, pin 52 will abut slot back end 55' during down movement of the door. During door raising, the slot 49 will move along pin 52 until the pin abuts slot forward end 54'. Force transfer then takes place and the door will begin to rise.

Although the embodiments of FIGS. 14–19 may be used with all types of overhead doors, they have particular utility for the aforementioned multi-panel doors that roll on opposing side tracks. In these embodiments, the deadbolt shaft and cable may be omitted. The bracket and delay means are the same as in FIGS. 1–13. Only the lift arm and keeper means are changed.

As best illustrated in FIGS. 14 and 15, lift arm 60 comprises a first section 61 that hangs edgewise from a pivot connection 62 on carriage 14. The section is preferably straight and may comprise overlapping parts for longitudinal adjustment. The parts are secured with part fasteners 63 extending through adjustment openings 64.

The first section merges at an obtuse angle "a" into locking portion 64. Preferably, the locking portion is straight and angle "a" is greater than about 100°. The locking portion includes a slide segment 66. This segment reciprocates within the slide channel of the bracket means previously described. Note that the bracket means is secured to the top end 73 of door panel 72 in centered alignment beneath the aforementioned carriage and track means.

The locking portion terminates outward from the slide segment at free end 67. When the door is in a down position, the free end is defined as that part of the locking portion that extends past the exterior surface plane of door panel 72 into an arm retention means.

As shown, the arm retention means comprises an engagement opening 69 which is sized to receive free end 67. The opening is formed into header 68 directly adjacent the bracket means. It may include a face plate 70 that outlines the opening. The plate is secured to the header with plate fasteners 71.

It will be understood that when the door is in a closed position, as shown in FIG. 14, the delay slots 48 should be horizontal. The locking portion should also be horizontal. Otherwise, difficulty may be incurred in free end movement into and out of the engagement opening.

Figure 11:
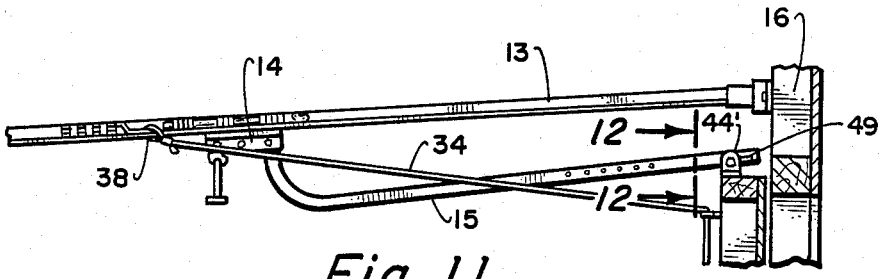
FIG. 11 is a fragmentary cross-sectional view similar to FIG. 2 showing an alternative delay means.
Figure 12:
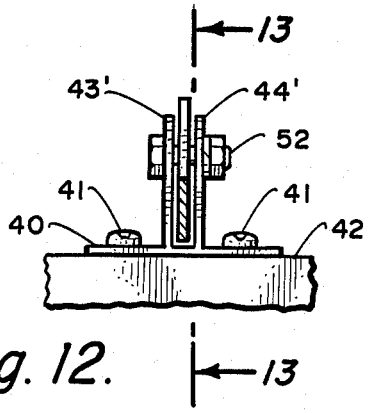
FIG. 12 is an enlarged elevational view taken along lines 12—12 of FIG. 11.
Figure 13:
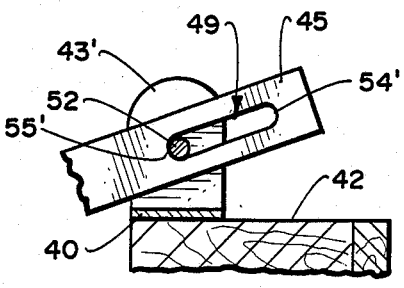
FIG. 13 is a cross-sectional view taken along lines 13—13 of FIG. 12.

Further, note that FIGS. 16 and 17 show the same modified delay means as that illustrated in FIGS. 11–13. Also, note that the length of the delay slots 48,49 should exceed the length of free end 67. Only in this way will the free end clear the retention means before the door commences upward movement as shown in FIG. 15.

In operation, the lift arm/delay means sequence is the same as with the FIGS. 1–13 embodiments. Upon rearward movement of carriage 14, the lift arm will move backward and free end 67 will withdraw from the engagement opening. Upon abutment of the hinge pin against the slot back end, the door will then begin rising along defined side tracks. When closing, the reverse action will occur with the hinge pin remaining in the slot back end until the door touches down. Continued forward movement of the carriage will then move the locking portion and free end forward until the hinge pin abuts against the slot forward end. At this point, the free end will be within the engagement opening and the door will be securely locked.

With the above uniquely defined locking portion and delay means, the lift arm is able to function as (1) a force transmission link, (2) a delay part, and (3) a locking part. Such triple function avoids the troublesome prior art mechanisms. It greatly simplifies the overall operation and is a significant advancement in the art.

While the invention has been described with respect to preferred embodiments, it will be apparent to those skilled in the art that other modifications may be made without departing from the scope and spirit of the invention. Accordingly, it is to be understood that the invention is not to be limited by the embodiments specifically described, but only by the scope of the appended claims.

I claim:

1. A deadbolt lock for an automatic door enclosing a garage having a floor, said door having an upper portion and a lower portion with a carriage movable along a powered track means and a lift arm connecting the carriage with the door for lifting and lowering the door about hinge means comprising:

a sleeve means mounted vertically to the inside lower portion of said door;

a shaft slidably engaged with said sleeve means having sufficient weight to overcome counteracting friction forces for gravity movement from an unlock position to a lock position when said door is lowered to a vertical position;

actuation means connecting said shaft with said carriage for moving said shaft upon movement of said carriage; and, bracket means mounted to said upper portion and a delay means connecting an outer end of said lift arm with said bracket means whereby said actuation means will move said shaft before said lift arm will move said door.

2. The lock of claim 1 wherein said bracket means comprises at least one pivot plate to which said lift arm is hinged by a hinge pin.

3. The lock of claim 2 wherein said delay means comprises an elongated slot in said lift arm with said hinge pin extending through said slot from its stationary securement to said pivot plate.

4. The lock of claim 2 wherein said hinge pin extends transversly from the side of said lift arm and said delay means comprises an elongated slot in said pivot plate through which said hinge pin extends.

5. The lock of claim 4 including a tension spring connecting said hinge pin to said pivot plate.

6. The lock of claim 1 including a lock opening in said floor adapted to engage said shaft when in said lock position.

7. The lock of claim 1 wherein said actuation means comprises any one or combination of a member selected from the group consisting of rope, wire, chain, cable and belt.

8. The lock of claim 7 wherein said upper portion includes a top end and said bracket means comprises two spaced-apart pivot plates extending upwardly from said top end.

9. In a door hinged at opposing sides to a door frame above a floor having a door opening and closing system including a carriage movable on a track means by a drive means with a lift arm connecting the carriage with said door whereby carriage movement will raise and lower said door to a respective open and closed position, wherein the improvement comprises:

a deadbolt lock assembly operating in response to said carriage movement including a vertical shaft reciprocably secured to the inside of said door, said shaft having sufficient weight to overcome counteracting friction forces to permit engagement with a floor keeper means by gravity movement of said shaft upon closing movement of said door to a vertical position;

bracket means including a pivot plate secured to said door having a hinge pin providing a hinged connection to said lift arm;

delay means comprising either a slot in the end of said lift arm or a slot through said plate allowing relative movement between said arm and plate before movement of said door; and, actuation means operatively connecting said shaft with said carriage whereby movement of said carriage will result in undelayed movement of said shaft.

10. The door of claim 9 wherein said actuation means comprises any one or combination of a member selected from the group consisting of rope, wire, chain, cable and belt.

11. A deadbolt lock assembly for a door movable about a horizontal axis by a lift arm connecting the door with a carriage driven by a powered track means, said lift arm attached to said door by hinge means that includes a hinge pin connecting an end of said arm to a pivot plate through a delay slot in either one of said plate or said end whereby movement of said carriage and lift arm will move said pin across said slot prior to pin engagement with said plate for moving said door;

guide means mounted upon the inside of said door;

a deadbolt shaft engaged with said guide means, said shaft having sufficient weight to overcome counteracting friction forces for movement by gravity into a keeper means beneath said door when said door moves into a closed vertical position; and, actuation means operatively connecting said shaft to said carriage to cause movement of said shaft in direct relation to movement of said carriage.

12. An automatic door operator in combination with a locking assembly comprising:

a support structure;

a carriage movable on a power driven transmitting means which is attached to said support structure;

a door mounted upon said support structure which is raised and lowered by operation of said carriage;

a bracket means attached to said door including a pivot plate extending from said door;

arm retention means secured to said support structure adjacent said bracket means;

a lift arm interconnecting said bracket means and said carriage for moving said door in response to movement of said carriage, said lift arm having a locking portion terminating at a free end which is attached to said bracket means by a hinge pin extending through a pivot opening in both of said pivot plate and said free end, with one of said pivot openings comprising a delay slot to permit relative movement between said pivot plate and said locking portion and movement of said free end into and out of engagement with said arm retention means.

13. The assembly of claim 12 wherein said arm retention means comprises an engagement opening adapted to confine said free end when said door is in a closed position.

14. The assembly of claim 13 wherein said support structure includes a header and said door includes an upper end which is adjacent said header when said door is in a closed position, said pivot plate upstanding from said upper end with said engagement opening on said header adjacent said pivot plate.

15. The assembly of claim 14 wherein said carriage is located above and rearward of said upper end when said door is in a closed position; said lift arm having a first section pivotally attached to said carriage which merges at an obtuse angle into said locking portion.

16. The assembly of claim 15 wherein said locking portion inclines at an angle greater than 100° from said first section.

17. The assembly of claim 16 wherein said locking portion is straight and horizontal when said door is in a closed position.

18. The assembly of claim 16 wherein said locking portion and said delay slot are about horizontal when said door is in a closed position.

* * * * *